US006773257B2

(12) United States Patent
Paschereit et al.

(10) Patent No.: US 6,773,257 B2
(45) Date of Patent: Aug. 10, 2004

(54) BURNER FOR THE PRODUCTION OF A HOT GAS

(75) Inventors: Christian Oliver Paschereit, Baden (CH); Ephraim Gutmark, Cincinnati, OH (US)

(73) Assignee: Alstom Technology Ltd, Baden (CH)

( * ) Notice: Subject to any disclaimer, the term of this patent is extended or adjusted under 35 U.S.C. 154(b) by 2 days.

(21) Appl. No.: 10/006,222

(22) Filed: Dec. 10, 2001

(65) Prior Publication Data

US 2002/0182553 A1 Dec. 5, 2002

(30) Foreign Application Priority Data

Dec. 23, 2000 (DE) ..... 100 65 206
Apr. 27, 2001 (DE) ..... 101 20 960

(51) Int. Cl.[7] ..... F23D 14/46
(52) U.S. Cl. ..... 431/114; 431/171; 431/351
(58) Field of Search ..... 431/114, 350, 431/351, 353, 172, 171, 173; 60/725, 737, 738

(56) References Cited

U.S. PATENT DOCUMENTS 5,489,203 A * 2/1996 Dobbeling et al. ..... 431/173
5,807,097 A * 9/1998 Dobbeling et al. ..... 431/351
5,865,609 A * 2/1999 Sowa et al. ..... 431/114
5,876,196 A * 3/1999 Knopfel et al. ..... 431/183
6,045,351 A * 4/2000 Dobbeling et al. ..... 431/8
6,056,538 A * 5/2000 Buchner et al. ..... 431/115

FOREIGN PATENT DOCUMENTS

| | | | | |
|---|---|---|---|---|
| DE | 19721937 A1 | | 12/1998 | |
| DE | 19736902 A1 | | 3/1999 | |
| EP | 0 849 531 A2 | | 6/1998 | |
| EP | 0 881 432 A2 | | 12/1998 | |
| EP | 0 918 152 A1 | | 5/1999 | |
| EP | 0931979 A1 | | 7/1999 | |
| EP | 0 972 986 A2 | * | 1/2000 | ..... F23D/14/46 |
| EP | 0 985 877 A1 | | 3/2000 | |
| EP | 0 987 495 A1 | | 3/2000 | |
| EP | 1 002 992 A1 | | 5/2000 | |
| EP | 1 048 898 A1 | | 11/2000 | |
| EP | 1 050 713 A1 | | 11/2000 | |
| WO | WO 99/06767 | | 2/1999 | |

OTHER PUBLICATIONS

Paschereit et al., "Structure and Control of Thermoacoustic Instabilities in a Gas–Turbine Burner Combustor", Science & Technology, vol. 138, pp. 213–232 (1998).

* cited by examiner

*Primary Examiner*—Josiah Cocks
(74) *Attorney, Agent, or Firm*—Burns, Doane, Swecker & Mathis, L.L.P.

(57) ABSTRACT

In a burner (10) for the production of a hot gas, which burner (10) opens with a burner outlet (22) edged with an outlet edge (16, 17) into a combustion chamber (23), in which a fuel-air mixture flowing out from the burner outlet (22) with the formation of an outflow boundary layer (18') forms a flame (20) after the ignition of the burner (10), the combustion process is improved in that, to prevent periodic releases of heat and the therewith connected thermoacoustic oscillations in the combustion chamber (23), means (21) are arranged at the burner outlet (22) for changing the thickness of the outflow boundary layer (18').

2 Claims, 3 Drawing Sheets

Prior Art

BURNER FOR THE PRODUCTION OF A HOT GAS

FIELD OF THE INVENTION

The present invention is concerned with the field of burner technology. It relates to a burner for the production of hot gases according to the preamble of claim 1.

DESCRIPTION OF PRIOR ART

The fluid-dynamic stability of a gas turbine burner is of critical importance for the occurrence of thermoacoustic oscillations. Fluid dynamic instability waves which arise at the burner lead to the formation of vortices (coherent structures) which affect the combustion and can lead to the periodic release of heat with the pressure fluctuations (thermoacoustic oscillations) connected therewith. Thermoacoustic oscillations represent a danger for any kind of combustion application. They lead to high amplitude pressure oscillations and to a limitation of the operating range, and can increase pollutant emissions. This particularly applies to combustion systems with little acoustic damping. In order to make high power conversion possible over a wide operating range in relation to pulsations and emissions, an active control of the combustion oscillations can be necessary.

Numerous proposals have already been made in the past, and possibilities shown, as to how the undesired thermoacoustic oscillations can be damped or completely suppressed in such burners, particularly in so-called double cone burners such as described, for example in EP-A2-0 881 432.

It is proposed in EP-A1-0 918 152 to control the thermoacoustic oscillation in a combustion system by arranging in the region of the burner, means for acoustic excitation of the working gas. This is of course connected with an additional apparatus and control expense. A similar acoustic design (EP-A1-1 050 713) works with an active suppression by means of a feedback control loop with a corresponding phase rotation.

In EP-A1-0 987 495, it is proposed to admix an inert gas, e.g., $N_2$, $CO_2$, or the like additionally to the fuel flow, in order to minimize thermoacoustic oscillations in gas turbine combustion chambers. However, this means an additional supply and duct system for the admixed inert gas.

Other solutions modify the geometry of the burner, particularly at the burner outlet: it is proposed in EP-A1-1 002 992 to arrange numerous nozzles in the burner along the periphery on the inside of the burner outlet, which introduce axial vortex intensities into the flow by the injection of air at an angle to the flow direction, for the control of flow instabilities in the burner.

EP-A1-0 985 877 furthermore proposes to accelerate the flow in the axial direction for minimizing thermoacoustic oscillations in gas turbine combustion chambers, in that the burner outlet is made nozzle-like, or additions of nozzle-like shape are installed on the burner.

Finally, in EP-A1-1 048 898 a burner (double cone burner) is disclosed in which numerous additions projecting into the flow are provided in order to introduce axial vortex intensities in the burner cone.

The present invention, on the contrary, proceeds from the following considerations: coherent structures play a critical role in mixing processes between air and fuel. The dynamics of these structures consequently affect the combustion and thus the liberation of heat. Control of combustion instabilities is possible by acting on the shear layer between the fresh gas mixture and the recirculated exhaust gas (see, e.g., Paschereit et al., "Structure and Control of Thermoacoustic Instabilities in a Gas Turbine Burner Combustion", Science & Technology, Vol. 138, pp. 213–232 (1998)). In particular, this offers the formation of coherent structures by means of having effects on the outflow boundary layer at the burner outlet.

SUMMARY OF THE INVENTION

The invention has as its object to provide a burner in which thermoacoustic oscillations can be limited or completely suppressed by very simple constructional means.

The object is attained by means of the totality of the features of claim 1. The basic concept of the invention is to affect the formation of coherent structures in a manner such that the occurrence of high-frequency, combustion-driven oscillations is prevented. Coherent structures are to be understood here as flow vortices, which arise due to flow instabilities in the shear layers which form at the burner outlet. The effect of coherent structures on the combustion instabilities is at its most pronounced when the flow instability has crossed its highest growth rate and the vortices have reached their maximum size. The axial position of the highest growth rate can be affected by, among other things, changing the thickness of the outflow boundary layer. By the prevention of the occurrence of vortex structures in the region of the flame, a periodic release of heat is prevented. A periodic release of heat, however, would be the basis for the occurrence of thermoacoustic oscillations, which are thus prevented.

A preferred embodiment of the invention is thus characterized in that the means for changing the thickness of the outflow boundary layer include a shear layer fence which runs along the outlet edge of the burner outlet and projects into the combustion chamber with its height substantially parallel to the flow direction. By means of the shear layer fence, which preferably has a height of a few millimeters, the thickness of the outflow boundary layer is increased in a particularly simple manner, and thus the vortex formation is displaced in the axial direction out of the region of the flame, with the cessation of periodic releases of heat which are connected with the vortex formation.

The burner is preferably constituted as a double-cone burner, and includes at least two hollow, conical partial members which are nested one in the other in the flow direction and whose mid-axes run mutually offset, such that adjacent walls of the partial members form tangential air inlet channels for the inflow of combustion air into the internal space bounded by the partial members, with the edges of the partial members toward the combustion chamber forming the outlet edges of the burner outlet.

BRIEF DESCRIPTION OF DRAWINGS

The invention is described in detail hereinafter using embodiment examples in connection with the accompanying drawing.

DESCRIPTION OF PREFERRED EMBODIMENTS

Figure 1:
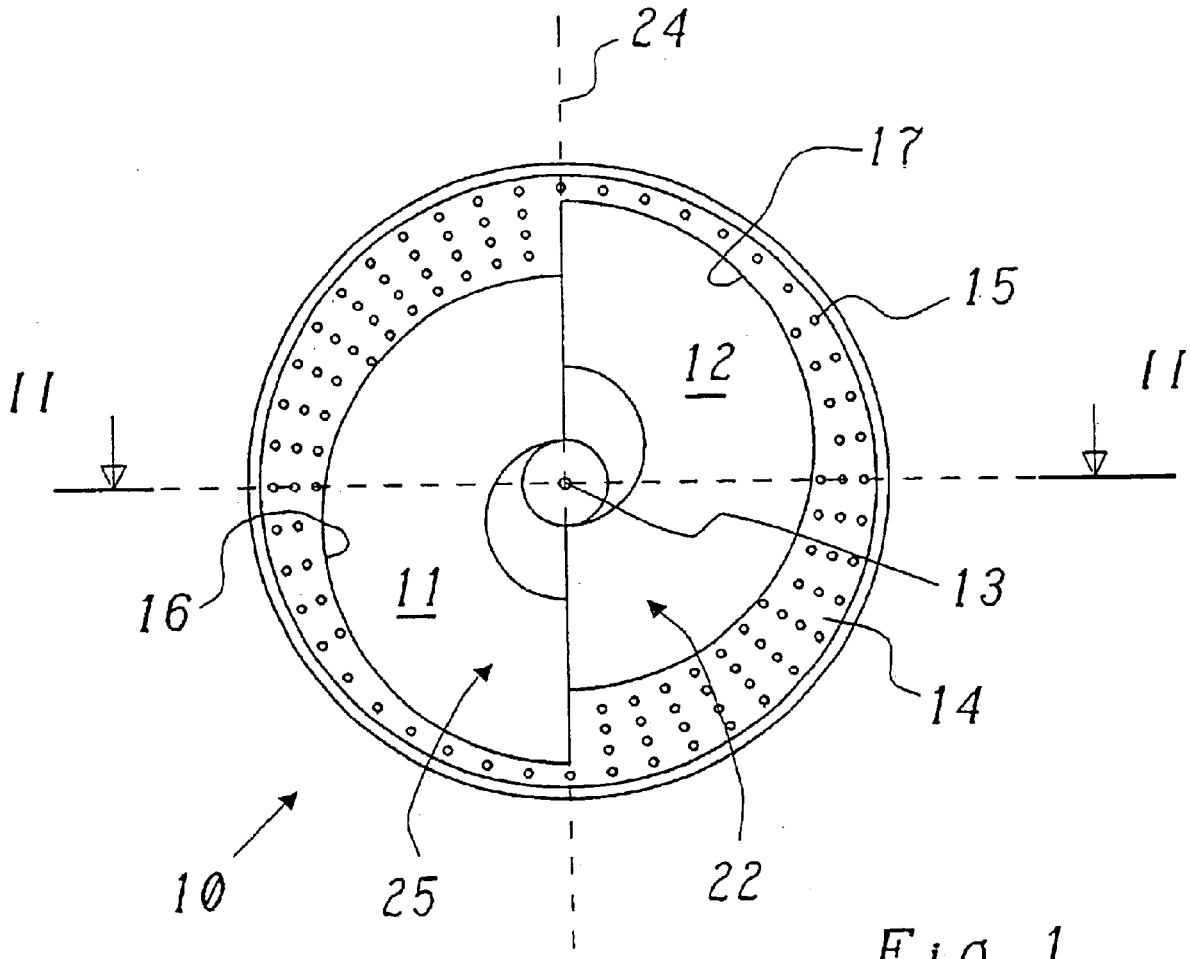
Fig. 1 Prior Art
FIG. 1 is a diagram showing in plan view, seen from in front (against the flow direction), the structure of a double cone burner, known per se, as is particularly suitable for the realization of the invention.
Figure 2:
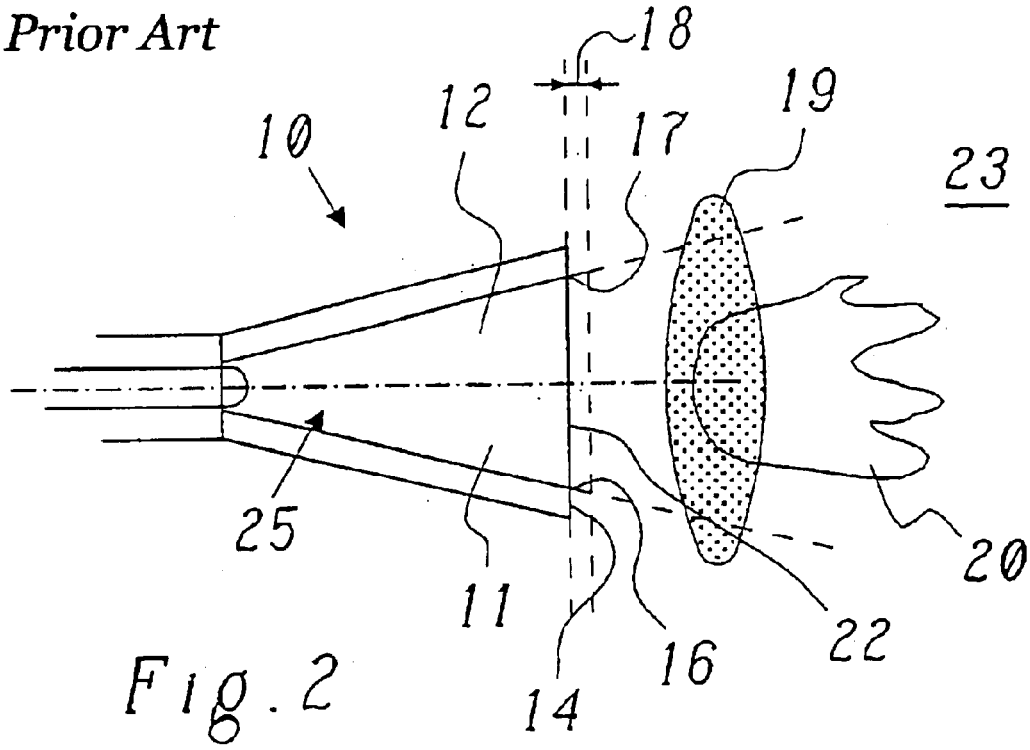
FIG. 2 is a diagram of the double cone burner of FIG. 1, in the conventional embodiment, in longitudinal section along the plane II—II of FIG. 1.

A plan view, seen from in front (against the flow direction), of the structure of a double cone burner is shown in FIG. 1, as is known from e.g. EP-A1-1 048 898 and particularly suitable for the realization of the invention. The burner 10 includes two conical partial members 11 and 12, which are mutually offset in a midplane, such that adjacent walls of the partial members 11, form tangential air inlets for the inflow of combustion air into the internal space 25 bounded by the partial members 11, 12. The internal space 25 opens with a burner outlet 22 a following combustion chamber 23 (FIG. 2). The edges of the partial members 11, 12 on the combustion chamber side form the outlet edges 16, 17 of the burner outlet 22. A front plate 14 is installed, extending transversely of the flow direction, around the burner outlet 22, and is provided with numerous bores 15 in a distributed arrangement.

Fuel is injected into the internal space 25 of the burner 10 through a central fuel nozzle 13 and is swirled with the tangentially inflowing air to give a fuel-air mixture. Air flows through the bores 15 parallel to the fuel-air mixture emerging from the burner outlet 22. The fuel-air mixture burns in the combustion chamber 23 with a flame 20. An outflow boundary layer 18 is formed at the outlet edges 16, 17 of the burner outlet 22, between the outflowing fuel-air mixture and the surrounding air. Shear layers with flow instabilities form in the outflow boundary layer 18 and lead to the formation of coherent structures in the form of flow vortices. The influence of these coherent structures on the combustion instabilities in the combustion chamber 23 is at its most pronounced when the flow instability has crossed its highest growth rate and the vortices 19 have reached their maximum size (FIG. 2).

If the position of the vortices of maximum size 19 is situated in the region of the flame 20, as shown in FIG. 2, periodic releases of heat occur and lead to the undesired thermoacoustic oscillations. The axial position of the highest growth rate of the coherent structures can however be affected by, among other things, changing the thickness of the outflow boundary layer 18. According to a preferred embodiment of the invention, this is attained by providing, according to FIG. 3, a shear layer fence 21, e.g., in the form of a sheet metal strip, which runs along the outlet edge 16, 17 of the burner outlet 22 and projects into the combustion chamber 23 with its height substantially parallel to the flow direction. By the shear layer fence 21, having a height of preferably a few millimeters, e.g. 5 mm, the occurrence of vortex structures in the region of the flame 20, and thus a periodic release of heat, is prevented (the vortices of maximum size 19 are displaced into a region outside the flame 20). A periodic release of heat would however be the basis for the occurrence of thermoacoustic oscillations, which are thus prevented.

Figure 3:
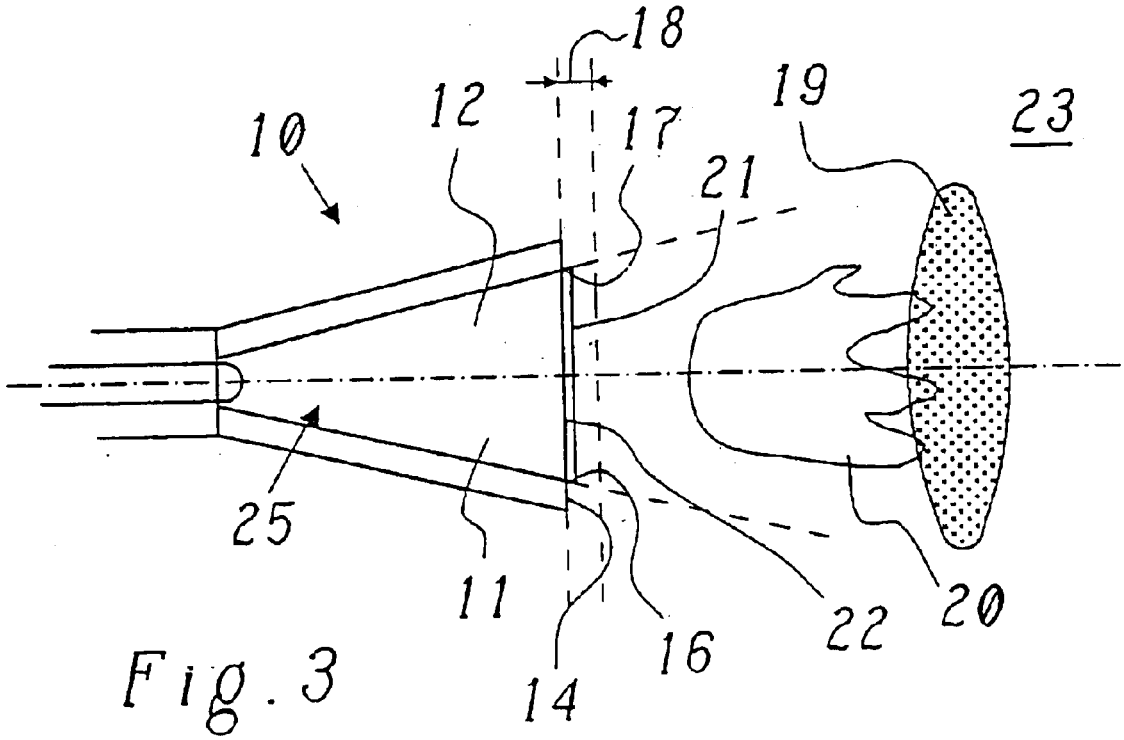
FIG. 3 is a diagram analogous to FIG. 2 showing a double cone burner according to a preferred embodiment example of the invention with a shear layer fence at the outlet edge of the burner outlet.
Figure 4:
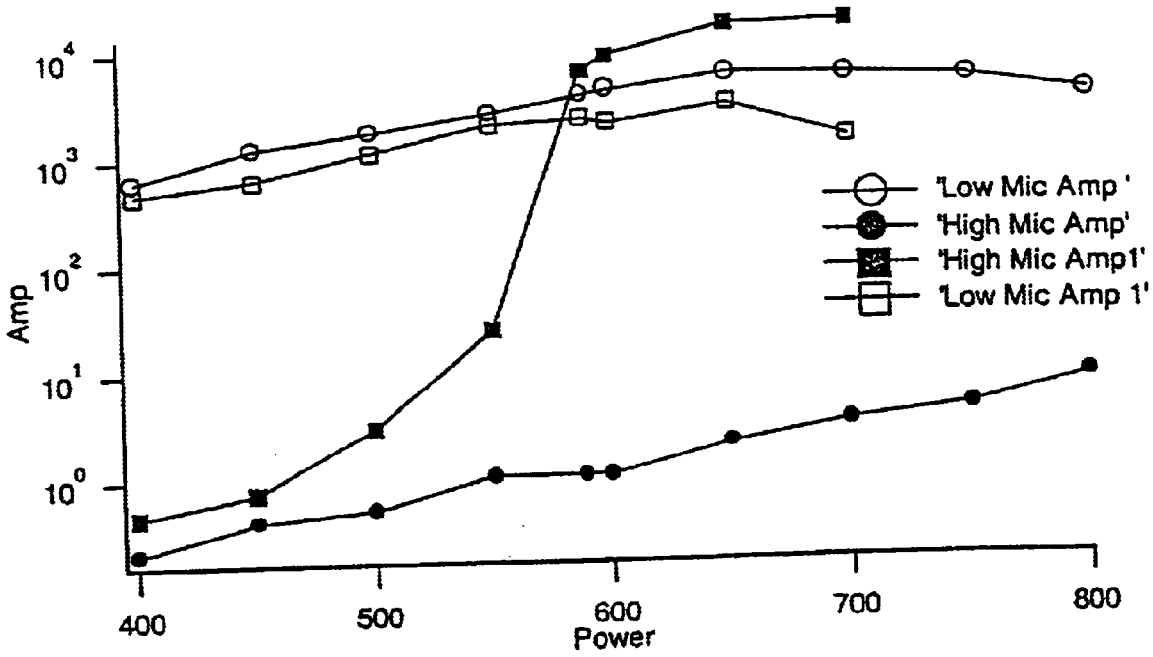
FIG. 4 is a diagram of the measured pressure amplitudes in dependence on the thermal power of an exemplary burner, with and without shear layer fence.

In FIG. 3, the effect of the invention on the suppression of a pressure oscillation in the 1,000 Hz region is shown. In FIG. 3 [sic: 4?], the pressure amplitudes (Amp) measured with two receivers are depicted in dependence on the thermal power of a burner with a shear layer fence 21 (solid circles and squares) and without a shear layer fence 21 (open circles and squares). It can be clearly seen from FIG. 3 [sic: 4?] that the occurrence of oscillations can be substantially prevented by means of the shear layer fence up to a given power point.

List of Reference Numerals

| | |
|---|---|
| 10 | burner (double cone burner) |
| 11, 12 | conical partial member |
| 13 | fuel nozzle |
| 14 | front plate |
| 15 | bore (front plate) |
| 16, 17 | outlet edge (burner outlet) |
| 18, 18' | outflow boundary layer |
| 19 | vortex of maximum size |
| 20 | flame |
| 21 | shear layer fence |
| 22 | burner outlet |
| 23 | combustion chamber |
| 24 | midplane |
| 25 | internal space |

What is claimed is:

1. A burner, comprising:

an internal space, means for introducing combustion air into said internal space, means for introducing fuel into said internal space, thus producing a fuel-air-mixture, the internal space opening with a burner outlet into a combustion chamber, the burner outlet having edges, a shear layer fence running along said outlet edge essentially adjacent the burner outlet, the shear layer fence projecting into the combustion chamber having a height substantially parallel to a flow direction of the outflowing fuel air mixture and the shear layer fence essentially surrounding the outflowing fuel air mixture, wherein the shear layer fence being made as a sheet metal strip and attached to the edges of the partial members;

wherein the burner is a double cone burner and includes at least two hollow, conical partial members that are mutually offset in a midplane, such that adjacent walls of the partial members form tangential air inlet channels for the inflow of combustion air into the internal space, said internal space being bounded by the partial members, with the edges of the partial members facing toward the combustion chamber forming the outlet edges of the burner outlet.

2. The burner according to claim 1, wherein the height of the shear layer fence is approximately 5 mm.

* * * * *